US006158221A

United States Patent [19]

Fancher et al.

[11] Patent Number: 6,158,221

[45] Date of Patent: Dec. 12, 2000

[54] WASTE HEAT RECOVERY TECHNIQUE

[75] Inventors: David H. Fancher, Windsor Locks, Conn.; Juan F. Garcia, Schenectady, N.Y.; Stephen L. Goodstine, Windsor, Conn.; Richard E. Waryasz, Longmeadow, Mass.

[73] Assignee: ABB Alstom Power Inc., Windsor, Conn.

[21] Appl. No.: 09/231,167

[22] Filed: Jan. 13, 1999

[51] Int. Cl.[7] ..... F01K 25/06

[52] U.S. Cl. ..... 60/649; 60/679; 60/693; 60/694

[58] Field of Search ..... 60/39.181, 39.182, 60/39.183, 649, 653, 655, 679, 693, 694

[56] References Cited

U.S. PATENT DOCUMENTS

| | | | |
|---|---|---|---|
| 4,012,191 | 3/1977 | Lisankie et al. | 432/179 |
| 4,476,674 | 10/1984 | Berman | 60/39.183 X |
| 4,489,563 | 12/1984 | Kalina | 60/673 |
| 4,660,375 | 4/1987 | Hyde et al. | 60/39.183 X |
| 4,732,005 | 3/1988 | Kalina | 60/673 |
| 4,982,568 | 1/1991 | Kalina | 60/649 |
| 5,029,444 | 7/1991 | Kalina | 60/673 |
| 5,095,708 | 3/1992 | Kalina | 60/673 |
| 5,271,161 | 12/1993 | Brinck, II | 34/21 |
| 5,440,882 | 8/1995 | Kalina | 60/641.2 |
| 5,450,821 | 9/1995 | Kalina | 122/1 |
| 5,572,871 | 11/1996 | Kalina | 60/649 |
| 5,577,377 | 11/1996 | Tomlinson | 60/39.182 X |
| 5,588,298 | 12/1996 | Kalina et al. | 60/673 |
| 5,755,089 | 5/1998 | Vanselow | 60/39.182 X |

OTHER PUBLICATIONS

Kalina Cycles for Efficient Direct Fired Application,–Alexander I. Kalina, Yakov Lerner, Richard I. Pelletier, Exergy, Inc. , Lawrence J. Peletz, Jr. ABB CE systems, Combustion engineering, Inc., –7pp. (No Date).

Kalina Cycle Looks Good for Combined Cycle Generation–Dr. James C. Corman, Dr. Robert W. Bjorge, GE Power Systems, Dr. Alexander Kalina, Exergy, Inc., Jul., 1995–3 pp.

Power Perspective, The Kalina Cycle–More Electricity From Eacth BTU of Fuel–1995–3 pp.

A Gas Turbine–Aqua Ammonia Combined Power Cycle–Irby Hicks, The Thermosorb Company–Mar. 25, 1996–6 pp.

Understanding the Kalina Cycle Fundamentals–H.A. Mlcak, P.E., ABB Lummus Crest–12 pp. (No Date).

Direct–Fired Kalina Cycle: Overview–ABB–1994–13 pp.

Kalina Cycle System Advancements for Direct Fired Power Generation, Michael J. Davidson, Lawrence J. Peletz, ABB Combustion Engineering,–9 pp. (No Date).

Kalina Cycles and System for Direct–Fired Power Plants, A.I. Kalina, Exergy, Inc., AES–vol. 25/HTD–vol. 191–7 pp. No Date.

*Primary Examiner*—Hoang Nguyen

*Attorney, Agent, or Firm*—Russell W. Warnock

[57] ABSTRACT

A waste heat recovery system includes a chamber. A gas inlet and gas outlet direct the flow of hot gas from a waste heat source to and from the chamber. A working fluid inlet port and working fluid outlet port direct the flow of multicomponent working fluid to and from the chamber. A plurality of heating surfaces are disposed within the chamber. The heating surfaces are formed of tubes which transport the flow of multicomponent working fluid from the inlet port to the outlet port such that the flow of the hot gas from the gas inlet to the gas outlet transfers heat from the hot gas to the flow of multicomponent working fluid.

68 Claims, 10 Drawing Sheets

WASTE HEAT RECOVERY TECHNIQUE

CROSS-REFERENCE TO RELATED APPLICATIONS

The present application relates to pending U.S. patent application Ser. No. 09/231,165, filed Jan. 13, 1999, for "TECHNIQUE FOR CONTROLLING REGENERATIVE SYSTEM CONDENSATION LEVEL DUE TO CHANGING CONDITIONS IN A KALINA CYCLE POWER GENERATION SYSTEM"; U.S. patent application Ser. No. 09/231,171, filed Jan. 13, 1999, for "TECHNIQUE FOR BALANCING REGENERATIVE REQUIREMENTS DUE TO PRESSURE CHANGES IAN A KALINA CYCLE POWER GENERATION SYSTEM", U.S. patent application Ser. No. 09/229,364, filed Jan. 13, 1999, for "TECHNIQUE FOR CONTROLLING SUPERHEATED VAPOR REQUIREMENTS DUE TO VARYING CONDITIONS IN A KALINA CYCLE POWER GENERATION SYSTEM"; U.S. patent application Ser. No. 09/231,166, tiled Jan. 13, 1999, for "TECHNIQUE FOR MAINTAINING PROPER DRUM LIQUID LEVEL IN A KALINA CYCLE POWER GENERATION SYSTEM"; U.S. patent application Ser. No. 09/229,629, filed Jan. 13, 1999, for "TECHNIQUE FOR CONTROLLING DCSS CONDENSATE LEVELS IN A KALINA CYCLE POWER GENERATION SYSTEM"; U.S. patent application Ser. No. 09/229,630, filed Jan. 13, 1999, for "TECHNIQUE FOR MAINTAINING PROPER FLOW IN PARALLEL HEAT EXCHANGERS IN A KALINA CYCLE POWER GENERATION SYSTEM"; U.S. patent application Ser. No. 09/229,631, filed Jan. 13, 1999, for "TECHNIQUE FOR MAINTAINING PROPER VAPOR TEMPERATURE AT THE SUPER HEATER/REHEATER INLET IN A KALINA CYCLE POWER GENERATION SYSTEM",; U.S. patent application Ser. No. 09/231,164, filed Jan. 13, 1999, for "WASTE HEAT KALINA CYCLE POWER GENERATION SYSTEM"; U.S. patent application Ser. No. 09/229,366, filed Jan. 13, 1999, for "MATERIAL SELECTION AND CONDITIONING TO AVOID BRITTLENESS CAUSED BY NITRIDING"; U.S. patent application Ser. No. 09/231,168, filed Jan. 13, 1999, for "REFURBISHING CONVENTIONAL POWER PLANTS FOR KALINA CYCLE OPERATION"; U.S. patent application Ser. No. 09/231,170, filed Jan. 13, 1999, for "STARTUP TECHNIQUE USING MULTIMODE OPERATION IN A KALINA CYCLE POWER GENERATION SYSTEM"; U.S. patent application Ser. No. 09/231, 163 filed Jan. 13, 1999, for "TECHNIQUE FOR COOLING FURNACE WALLS IN A MULTI-COMPOMENT WORKING FLUID POWER GENERATION SYSTEM"; U.S. patent application Ser. No. 09/229,632, filed Jan. 13, 1999, for "BLOWDOWN RECOVERY SYSTEM IN A KALINA CYCLE POWER GENERATION SYSTEM"; U.S. patent application Ser. No. 09/229,368, filed Jan. 13, 1999, for "REGENERATIVE SUBSYSTEM CONTROL IN A KALINA CYCLE POWER GENERATION SYSTEM"; U.S. patent application Ser. No. 09/229,363, filed Jan. 13, 1999, for "DISTILLATION AND CONDENSATION SUBSYSTEM (DCSS) CONTROL IN A KALINA CYCLE POWER GENERATION SYSTEM"; U.S. patent application Ser. No. 09/229,365, filed Jan. 13, 1999, for "VAPOR TEMPERATURE CONTROL IN A KALINA CYCLE POWER GENERATION SYSTEM"; U.S. patent application Ser. No. 09/229,367, filed Jan. 13, 1999, for "A HYBRID DUAL CYCLE VAPOR GENERATOR"; U.S. patent application Ser. No. 09/231,169, filed Jan. 13, 1999, for "FLUIDIZED BED FOR KALINA CYCLE POWER GENERATION SYSTEM".

FIELD OF THE INVENTION

The present invention relates to heat recovery techniques and more particularly to an improved waste heat recovery technique utilizing a multicomponent working fluid, such as that utilized in a Kalina cycle.

BACKGROUND OF THE INVENTION

In recent years, industrial and utility concerns with deregulation and operational costs have strengthened demands for increased power plant efficiency. The Rankine cycle power plant, which typically utilizes water as the working fluid, has been the mainstay for the utility and industrial power industry for the last 150 years. In a Rankine cycle power plant, heat energy is converted into electrical energy by heating a working fluid flowing through tubular walls, commonly referred to as waterwalls, to form a vapor, e.g., turning water into steam. Typically, the vapor will be superheated to form a high pressure vapor, e.g., superheated steam. The high pressure vapor is used to power a turbine/generator to generate electricity.

Conventional Rankine cycle power generation systems can be of various types, including direct-fired, fluidized bed and waste-heat type systems. In direct fired and fluidized bed type systems, combustion process heat is generated by burning fuel to heat the combustion air which in turn heats the working fluid circulating through the systems' waterwalls. In direct-fired Rankine cycle power generation systems the fuel, commonly pulverized-coal, gas or oil, is ignited in burners located in the waterwalls. In bubbling fluidized bed Rankine cycle power generation systems pulverized-coal is ignited in a bed located at the base of the boiler to generate combustion process heat. Waste-heat Rankine cycle power generation systems rely on heat generated in another process, e.g., incineration, for process heat to vaporize, and if desired superheat, the working fluid. Due to the metallurgical limitations, the highest temperature of the superheated steam does not normally exceed 1050° F. (566° C.). However, in some "aggressive" designs, this temperature can be as high as 1100° F. (593° C.).

Over the years, efficiency gains in Rankine cycle power systems have been achieved through technological improvements which have allowed working fluid temperatures and pressures to increase and exhaust gas temperatures and pressures to decrease. An important factor in the efficiency of the heat transfer is the average temperature of the working fluid during the transfer of heat from the heat source. If the temperature of the working fluid is significantly lower than the temperature of the available heat source, the efficiency of the cycle will be significantly reduced. This effect, to some extent, explains the difficulty in achieving further gains in efficiency in conventional, Rankine cycle-based, power plants.

In view of the above, a departure from the Rankine cycle has recently been proposed. The proposed new cycle, commonly referred to as the Kalina cycle, attempts to exploit the additional degree of freedom available when using a binary fluid, more particularly an ammonia/water mixture, as the working fluid. The Kalina cycle is described in the paper entitled: "Kalina Cycle System Advancements for Direct Fired Power Generation", co-authored by Michael J. Davidson and Lawrence J. Peletz, Jr., and published by /combustion Engineering, Inc., of Windsor, Conn. Efficiency gains are obtained in the Kalina cycle plant by reducing the energy losses during the conversion of heat energy into electrical output.

A simplified conventional direct-fired Kalina cycle power generation system is illustrated in FIG. 1 of the drawings.

Kalina cycle power plants are characterized by three basic system elements, the Distillation and Condensation Subsystem (DCSS) 100, the Vapor Subsystem (VSS) 110 which includes the boiler 142, superheater 144 and recuperative heat exchanger (RHE) 140, and the turbine/generator subsystem (TGSS) 130. The DCSS 100 and RHE 140 are sometimes jointly referred to as the Regenerative Subsystem (RSS) 150. The boiler 142 is formed of tubular walls 142*a* and the superheater 144 is formed of tubular walls and/or banks of fluid tubes 144*a*. A heat source 120 provides process heat 121. A portion 123 of the process heat 121 is used to vaporize the working fluid in the boiler 142. Another portion 122 of the process heat 121 is used to superheat the vaporized working fluid in the superheater 144.

During normal operation of the Kalina cycle power system of FIG. 1, the ammonia/water working fluid is fed to the boiler 142 from the RHE 140 by liquid stream FS 5 and from the DCSS 100 by liquid stream FS 7. The working fluid is vaporized, i.e., boiled, in the tubular walls 142*a* of the boiler 142. The FS rich working fluid stream 20 from the DCSS 100 is also vaporized in the heat exchanger(s) of the RHE 140.

In one implementation, the vaporized working fluid from the boiler 142 along with the vaporized working fluid FS 9 from the RHE 140, is further heated in the tubular walls/fluid tube bank 144*a* of the superheater 144. The superheated vapor from the superheater 144 is directed to and powers the TGSS 130 as FS vapor 40 so that electrical power 131 is generated to meet the load requirement. In an alternative implementation, the RHE 140 not only vaporizes but also superheats the rich stream FS 20. In such a case, the superheated vapor flow FS 9' from the RHE 140 is combined with the superheated vapor from the superheater 144 to form FS vapor flow 40 to the TGSS 130.

Expanded working fluid FS extraction 11 egresses from the TGSS 130, e.g., from a low pressure (LP) turbine (not shown) within the TGSS 130, and is directed to the DCSS 100. This expanded working fluid is, in part, condensed in the DCSS 100. Working fluid condensed in the DCSS 100, as described above, forms feed fluid FS 7 which is fed to the boiler 142. Another key feature of the DCSS 100 is the separation of the working fluid egressing from TGSS 130 into ammonia rich and ammonia lean streams for use by the VSS 110. In this regard, the DCSS 100 separates the expanded working fluid into an ammonia rich working fluid flow FS rich 20 and an ammonia lean working fluid flow FS lean 30. Waste heat 101 from the DCSS 100 is dumped to a heat sink, such as a river or pond.

The rich and lean flows FS 20, FS 30, respectively, are fed to the RHE 140. Another somewhat less expanded hot working fluid FS extraction 10 egresses from the TGSS 130, e.g., from a high pressure (HP) turbine (not shown) within the TGSS 130, and is directed to the RHE 140. Heat is transferred from the expanded working fluid FS extraction 10 and the working fluid FS lean stream 30 to the rich working fluid flow FS rich 20, to thereby vaporize the rich flow FS 20 and condense, at least in part, the expanded working fluid FS extraction 10 and FS lean working fluid flow 30, in the RHE 140. As discussed above, the vaporized rich flow FS 20 is fed to either the superheater 144, along with vaporized feed fluid from the boiler 142, or is combined with the superheated working fluid from the superheater 142 and fed directly to the TGSS 130. The condensed expanded working fluid from the RHE 140 forms part of the feed flow, i.e., flow FS 5, to the boiler 142, as has been previously described.

FIG. 2 details a portion of the RHE 140 of VSS 110 of FIG. 1. As shown, the RHE 140 receives ammonia-rich, cold high pressure stream FS rich 20 from DCSS 100. Stream FS rich 20 is heated by ammonia-lean hot low pressure stream FS 3010. The stream FS 3010 is formed by combining the somewhat lean hot low pressure extraction stream FS 10 from TGSS 130 with the lean hot low pressure stream FS 30 from DCSS 100, these flows being combined such that stream FS 30 dilutes stream FS 10 resulting in a desired concentration of ammonia in stream FS 3010.

Heat energy 125, is transferred from stream FS 3010 to stream FS rich 20. As discussed above, this causes the transformation of stream FS 20 into a high pressure vapor stream FS 9 or the high pressure superheated vapor stream FS 9', depending on the pressure and concentration of the rich working fluid stream FS 20. This also causes the working fluid stream FS 3010 to be condensed. This condensed working fluid serves as a liquid feed flow FS 5 to the boiler 142.

As previously discussed, in one implementation the vapor stream FS 9, along with the vapor output from boiler 142, forms the vapor input to the superheater 144, and the superheater 144 superheats the vapor stream to form superheated vapor stream 40 which is used to power TGSS 130. Alternatively, the superheated vapor steam FS 9', along with the superheated vapor output from the superheater 144, forms the superheated vapor stream FS 40 to the TGSS 130.

FIG. 3 illustrates exemplary heat transfer curves for heat exchanges occurring in the RHE 140 of FIG. 2. A typical Kalina cycle heat exchange is represented by curves 520 and 530. As shown, the temperature of the liquid binary working fluid FS 20 represented by curve 520 increases as a function of the distance of travel of the working fluid through the heat exchanger of the RHE 140 in a substantially linear manner. That is, the temperature of the working fluid continues to increase even during boiling as the working fluid travels through the heat exchanger of the RHE 140 shown in FIG. 2. At the same time, the temperature of the liquid working fluid FS 3010 represented by curve 530 decreases as a function of the distance of travel of this working fluid through the heat exchanger of the RHE 140 in a substantially linear manner. That is, as heat energy 125 is transferred from working fluid FS 3010 to the working fluid stream FS 20 as both fluid streams flow in opposed directions through the RHE 140 heat exchanger of FIG. 2, the binary working fluid FS 3010 loses heat and the binary working fluid stream FS 20 gains heat at substantially the same rate within the Kalina cycle heat exchangers of the RHE 140.

In contrast, a typical Rankine cycle heat exchange is represented by curve 510. As shown, the temperature of the water or water/steam mixture forming the working fluid represented by curve 510 increases as a function of the distance of travel of the working fluid through a heat exchanger of the type shown in FIG. 2 only after the working fluid has been fully evaporated, i.e., vaporized. The portion 511 of curve 510 represents the temperature of the water or water/steam mixture during boiling. As indicated, the temperature of the working fluid remains substantially constant until the boiling duty has been completed. That is, in a typical Rankine cycle, the temperature of the working fluid does not increase during boiling. Rather, as indicated by portion 512 of curve 510, it is only after full vaporization, i.e., full phase transformation, that the temperature of the working fluid in a typical Rankine cycle increases beyond the boiling point temperature of the working fluid, e.g., 212° F.

As will be noted, the temperature differential between the stream represented by curve 530, which transfers the heat energy, and the Rankine cycle stream represented by curve 510, which absorbs the heat energy, continues to increase during phase transformation. The differential becomes greatest just before complete vaporization of the working fluids. In contrast, the temperature differential between the stream represented by curve 530, and the Kalina cycle stream represented by curve 520, which absorbs the heat energy, remains relatively small, and substantially constant, during phase transformation. This further highlights the enhanced efficiency of Kalina cycle heat exchange in comparison to Rankine cycle heat exchange.

As indicated above, the transformation in the RHE 140 of the liquid or mixed liquid/vapor stream FS 20 to vapor or superheated vapor stream FS 9 or 9' is possible in the Kalina cycle because, the boiling point of rich cold high pressure stream FS 20 is substantially lower than that of lean hot low pressure stream FS 3010. This allows additional boiling, and in some implementations superheating, duty to be performed in the Kalina cycle RHE 140 and hence outside the boiler 142 and/or superheater 144. Hence, in the Kalina cycle, a greater portion of the process heat 121 can be used for superheating vaporized working fluid in the superheater 144, and less process heat 121 is required for boiling duty in the boiler 142. The net result is increased efficiency of the power generation system when compared to a conventional Rankine cycle type power generation system.

FIG. 4 further depicts the TGSS 130 of FIG. 1. As illustrated, the TGSS 130 in a Kalina cycle power generation system is driven by a high pressure superheated binary fluid vapor stream FS 40. Relatively lean hot low pressure stream FS extraction 10 is directed from, for instance the exhaust of an HP turbine (not shown) within the TGSS 130 to the RHE 140 as shown in FIGS. 1 and 2. A relatively lean cooler, even lower pressure flow FS extraction 11 is directed from, for instance, the exhaust of an LP turbine (not shown) within the TGSS 130 to the DCSS 100 as shown in FIG. 1. As has been discussed to some extent above, both FS extraction flow 10 and FS extraction flow 11 retain enough heat to transfer energy to still cooler higher pressure streams in the DCSS 100 and RHE 140.

As mentioned above, in contrast to direct fired vapor generating systems, waste heat recovery vapor generators use waste heat from an external source, such as a vapor generator or a gas turbine, to produce high pressure vapor which can be used to, for example, drive a turbine. Conventional waste heat recovery steam generators utilize a Rankine cycle to produce high pressure steam to drive a steam turbine. Because such systems are water based, the isothermal boiling characteristic of the water as it undergoes a change of phase imposes certain limitations on the design of heat exchanger. More particularly, in such systems the flue gas temperature will, at the inlet end of the evaporator, approach the working fluid temperature. This point is commonly referred to as the pinch point. Due to the pinch point, working fluid pressures are varied in conventional waste heat vapor generators so that vaporization of the working fluid can occur at a lower temperature. This allows a greater recovery of energy from the waste heat than would otherwise be possible. However, even using this technique, conventional waste heat vapor generators are inefficient at recovering the full energy potential from the available waste heat source.

OBJECTS OF THE INVENTION

Accordingly, it is an object of the present invention to provide a technique to more efficiently recover waste heat.

It is another object of the present invention to provide a technique for recovering waste heat which uses a non-Rankine heat transfer cycle.

It is a further object of the present invention to provide a technique for recovering waste heat in which heat transfer characteristics are improved.

Additional objects, advantages, and novel features of the present invention will become apparent to those skilled in the art from this disclosure, including the following detailed description, as well as by practice of the invention. While the invention is described below with reference to a preferred embodiment(s), it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

SUMMARY OF THE INVENTION

According to the present invention a waste heat recovery system includes a chamber, typically in the form of a duct. An insulating refractory material or an insulating non-refractory material is beneficially installed within the chamber to form a surface for contacting hot gas which will flow in the chamber. Preferably, non-refractory insulating material is used only when a small amount of particulate matter will be carried by the hot gas. A gas inlet, which could for example be in the form of a plenum duct, directs the flow of hot gas from a waste heat source to the chamber. The waste heat source may, for example be a vapor generator, gas turbine or other type of generator of otherwise unusable heat. A gas outlet, which could for example be an exhaust duct, directs the flow of hot gas from the chamber.

A working fluid inlet port directs a flow of multicomponent working fluid, such as ammonia/water working fluid of the type commonly used in a Kalina cycle, to the chamber. A working fluid outlet port directs the flow of multicomponent working fluid from the chamber. A plurality of heating surfaces are disposed within the chamber. The heating surfaces are formed of tubes which transport the flow of multicomponent working fluid from the inlet port to the outlet port, preferably at a substantially constant pressure. While being transported by the tubes, the hot gas flowing from the gas inlet to the gas outlet transfers heat to the multicomponent working fluid flowing within the tubes from the fluid inlet to the fluid outlet. Preferably, the tubes are configured so that the working fluid need only pass thought the chamber once to be fully vaporized, and if desired superheated.

According to other aspects of the invention, the tubes may be segmented. For example, the tube segments may form a preheater for preheating the flow of multicomponent working fluid from the inlet port, a boiler for vaporizing the flow of preheated multicomponent working fluid from the preheater, and a superheater for superheating the flow of vaporized multicomponent working fluid from the boiler. Beneficially, the tube segments forming the preheater are positioned at a higher elevation within the chamber than the tube segments forming the boiler, and the tube segments forming the boiler are positioned at a higher elevation within the chamber than the tube segments forming the superheater. These segments can, if desired, be manufactured as modules to ease shipment and site construction.

In accordance with another aspect of the invention, a header is provided to receive the vaporized multicomponent working fluid from one of the tube segments and to provide the vaporized multicomponent working fluid as an output to another of the tube segments. The header, beneficially equalizes the pressure and/or temperature of the received vaporized multicomponent working fluid prior to passing the vaporized multicomponent working fluid onto the other tube segments.

The transfer of heat from the hot gas may, under certain operating conditions, only partially vaporize the multicomponent working fluid transported by the tube segments forming the boiler. Accordingly, a separator may be provided to receive the two phase multicomponent working fluid transported by these tube segments, and to separate the received two phase multicomponent working fluid into a vaporized multicomponent working fluid and a liquid multicomponent working fluid. Only the vaporized multicomponent working fluid is transported by the tube segments forming the superheater.

Preferably, a first header is provided to collect the multicomponent working fluid transported by the tube segments forming the boiler. A header port directs the two phase multicomponent working fluid collected by the first header to the separator. A second header collects the vaporized multicomponent working fluid from the separator and directs it to the tube segments forming the superheater. A valve can optionally be provided to control the flow of multicomponent working fluid to the separator. The valve is operable to allow the multicomponent working fluid to flow to the separator in one mode of operation, e.g., during start-up or low-load operations, and block the flow to the separator in another mode of operation, e.g., normal operations. Another header port can optionally be provided to direct the multicomponent working fluid collected by the first header to the second header when the flow to the separator is blocked. This way, with the optional valve, the second header receives the vaporized multicomponent working fluid from the separator in one mode of operation and receives the vaporized multicomponent working fluid from the first header in another mode of operation.

Beneficially, the tubes can be arranged so as to meander between the fluid inlet and outlet. Preferably, a substantial portion of each of the tubes has a substantially horizontal disposition, i.e., only a very slight downward slope. The tubes can be arranged so as to be completely drainable and a drainage port and valve can be installed to facilitate drainage of the tubes.

A damper, preferably positioned proximate to the gas outlet, is beneficially provided to adjust the flow of hot gas within the chamber. The adjustment of the flow can be used to change the rate of the flow of hot gas and thereby control the temperature of the multicomponent working fluid at the working fluid outlet port.

A valve, preferably located proximate to the inlet port, is also advantageously provided to adjust the flow of multicomponent working fluid in the tubes. The valve could, if desired, be provided, in lieu of the damper. The adjustment of the valve can be used to change the rate of the flow of multicomponent working fluid in the tubes and thereby provide further control of the temperature of the multicomponent working fluid at the working fluid outlet port.

According to other aspects of the invention, the flow of hot gas within the chamber is in one general direction, e.g., generally upward, while the flow of multicomponent working fluid is in an opposed general direction, e.g., generally downward. Hence the flows are counter to each other. Preferably, the gas inlet is located close to the working fluid outlet port and away from the working fluid inlet port, and the gas outlet is located close to the working fluid inlet port and away from the working fluid outlet port. In a particularly beneficial arrangement, the gas inlet and working fluid outlet port are located near the bottom of the chamber and the gas outlet and working fluid inlet port are located near the top of the chamber; hence, the gas inlet can be at a lower elevation than the gas outlet and the working fluid outlet port can be at a lower elevation than the working fluid inlet port.

According to still other aspects of the invention, the inner diameter of each of the tubes forms a flow path for the multicomponent working fluid and has one or more ribs. Preferably, the ribs are disposed within the portion of the flow path in which the multicomponent working fluid is vaporized. At least a portion of each of the tubes may be formed of carbon steel or austenitic steel. Beneficially, the portion of each of the tubes in which the multicomponent working fluid is superheated is made of austenitic steel.

A by-pass chamber may, if desired, also be provided to direct a separate flow of the hot gas from the waste heat source outside the main chamber described above. This flow may be maintained concurrent with the flow of the hot gas directed through the main chamber. A damper operable to control the amount of hot gas directed by the by-pass chamber is typically provided to control the amount of hot gas directed to the by-pass chamber and main chamber. By adjusting the damper, the temperature of the multicomponent working fluid at the working fluid outlet port can be controlled.

According to still other aspects of the invention, a turbine receives the flow of superheated multicomponent working fluid. The superheated multicomponent working fluid is expanded by the turbine to generate power. A regenerative subsystem, such as the RSS of a Kalina cycle power generation system receives the expanded multicomponent working fluid. The expanded multicomponent working fluid is condensed, at least in part, by transferring heat from the expanded multicomponent working fluid to other multicomponent working fluid. Such transfers are commonly performed in, for example, Kalina type power generation systems. The condensed multicomponent working fluid forms a feed fluid to supply at least a part of the flow of multicomponent working fluid directed to the working fluid inlet port.

The regenerative subsystem may also receive the liquid multicomponent working fluid from the previously described separator. In such a case, the liquid multicomponent working fluid transfers heat to other multicomponent working fluid, and is thereby cooled. This cooled multicomponent working fluid can also form a feed working fluid for supplying part of the flow of multicomponent working fluid directed to the working fluid inlet port.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF THE INVENTION

Figure 1:
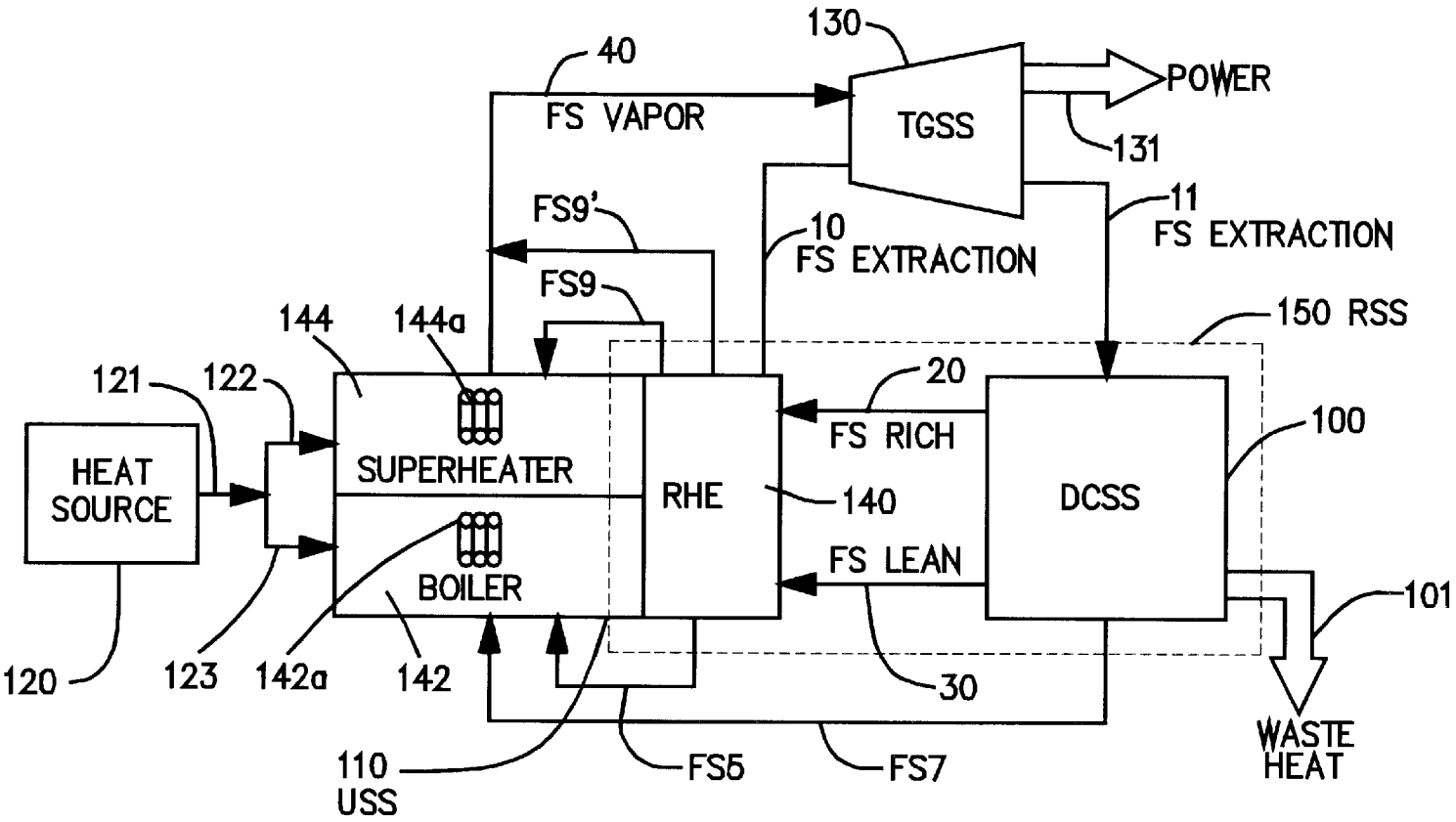
Figure 1 (PRIOR ART)
FIG. 1 is a simplified block diagram of a prior art Kalina cycle power generation system.
Figure 2:
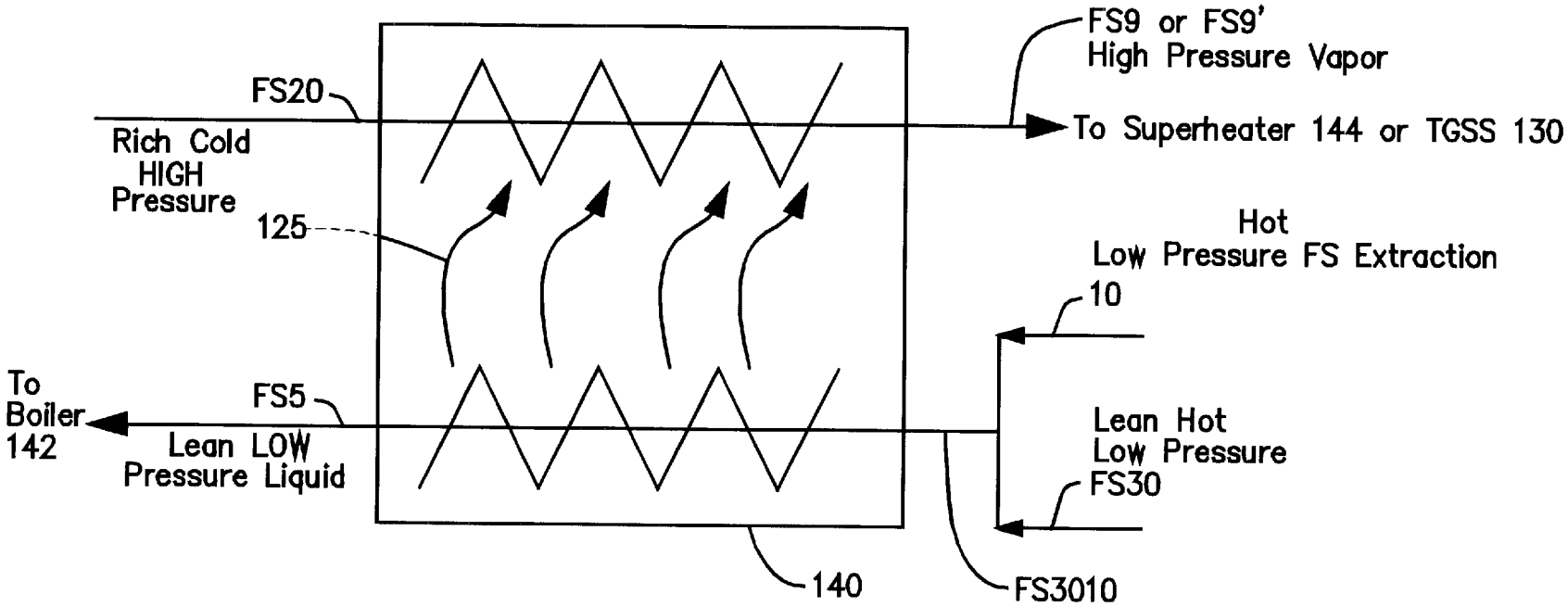
Figure 2 (PRIOR ART)
FIG. 2 is a diagram illustrating basic heat exchange between two flow streams in the recuperative heat exchanger (RHE) of the conventional Kalina cycle power generation system of FIG. 1.
Figure 3:
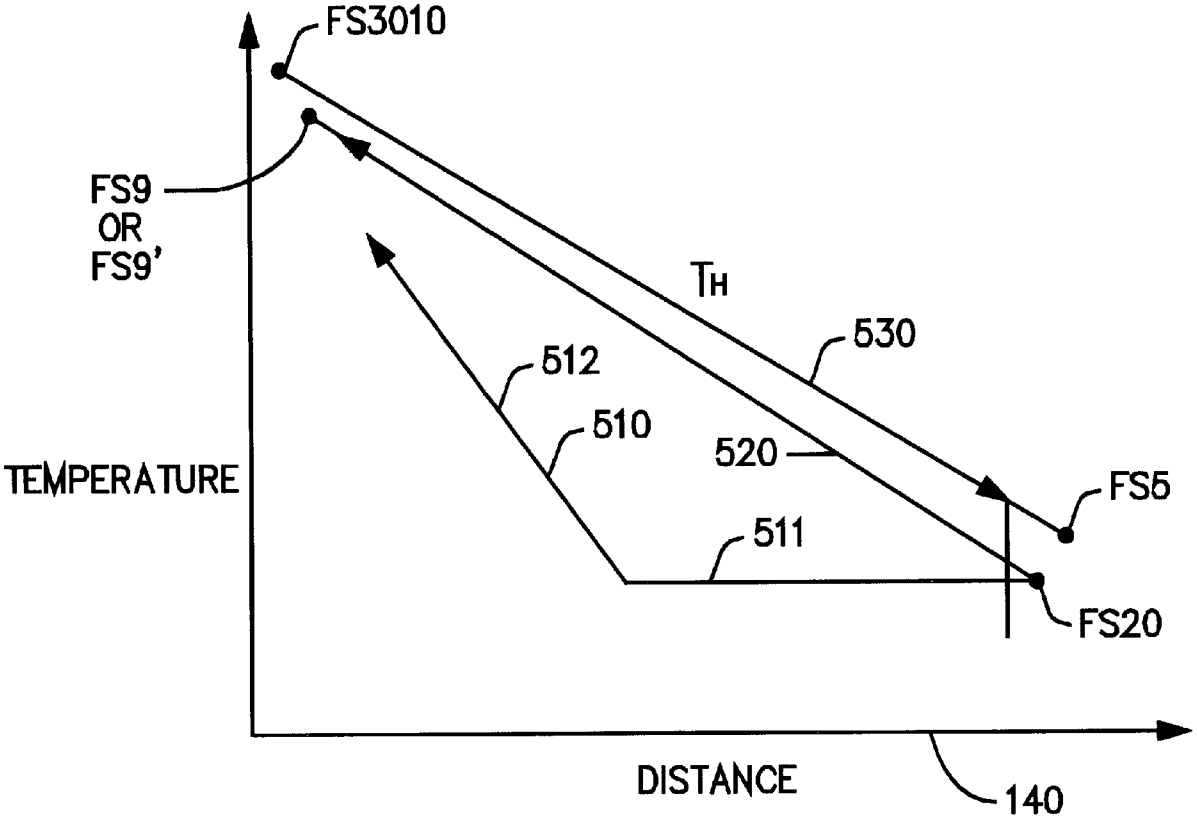
Figure 3 (PRIOR ART)
FIG. 3 is a graph illustrating exemplary heat transfer exchanges in the recuperative heat exchanger (RHE) of the conventional Kalina cycle power generation system shown in FIG. 2.
Figure 4:
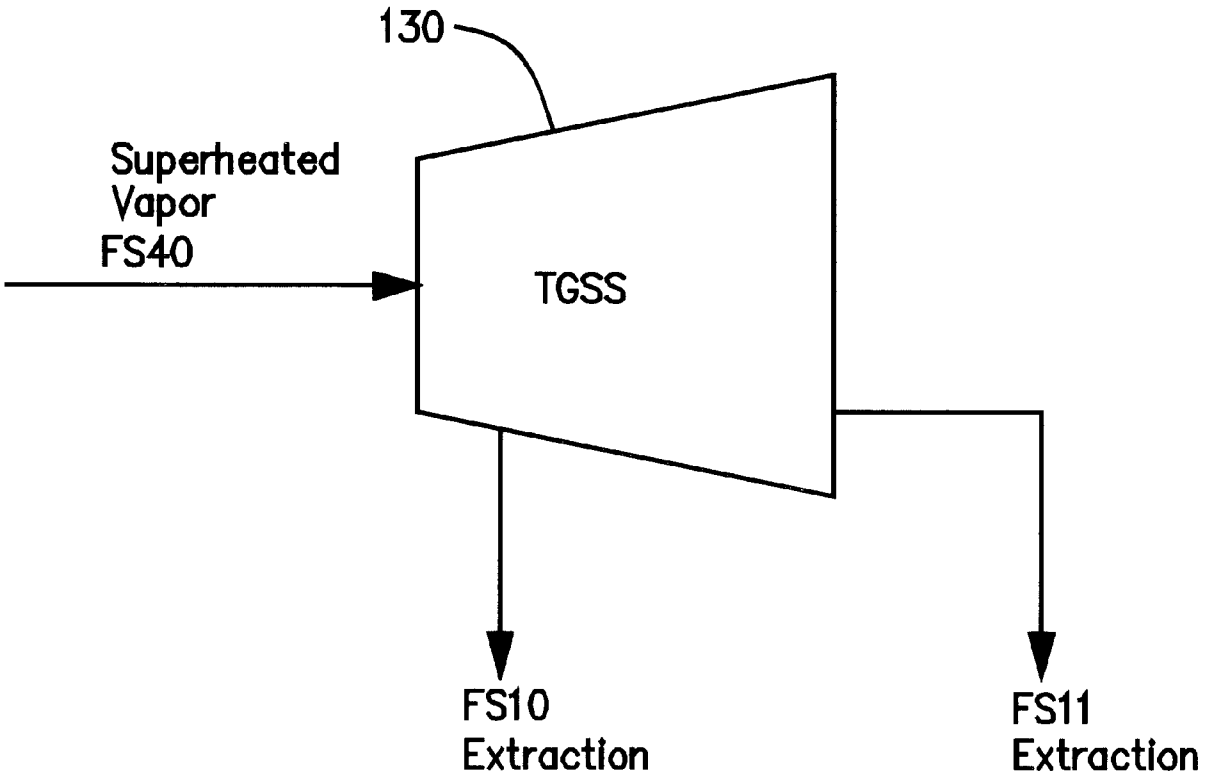
Figure 4 (PRIOR ART)
FIG. 4 is a diagram further illustrating the turbine/generator subsystem (TGSS) of the conventional Kalina cycle system shown in FIG. 1.
Figure 5:
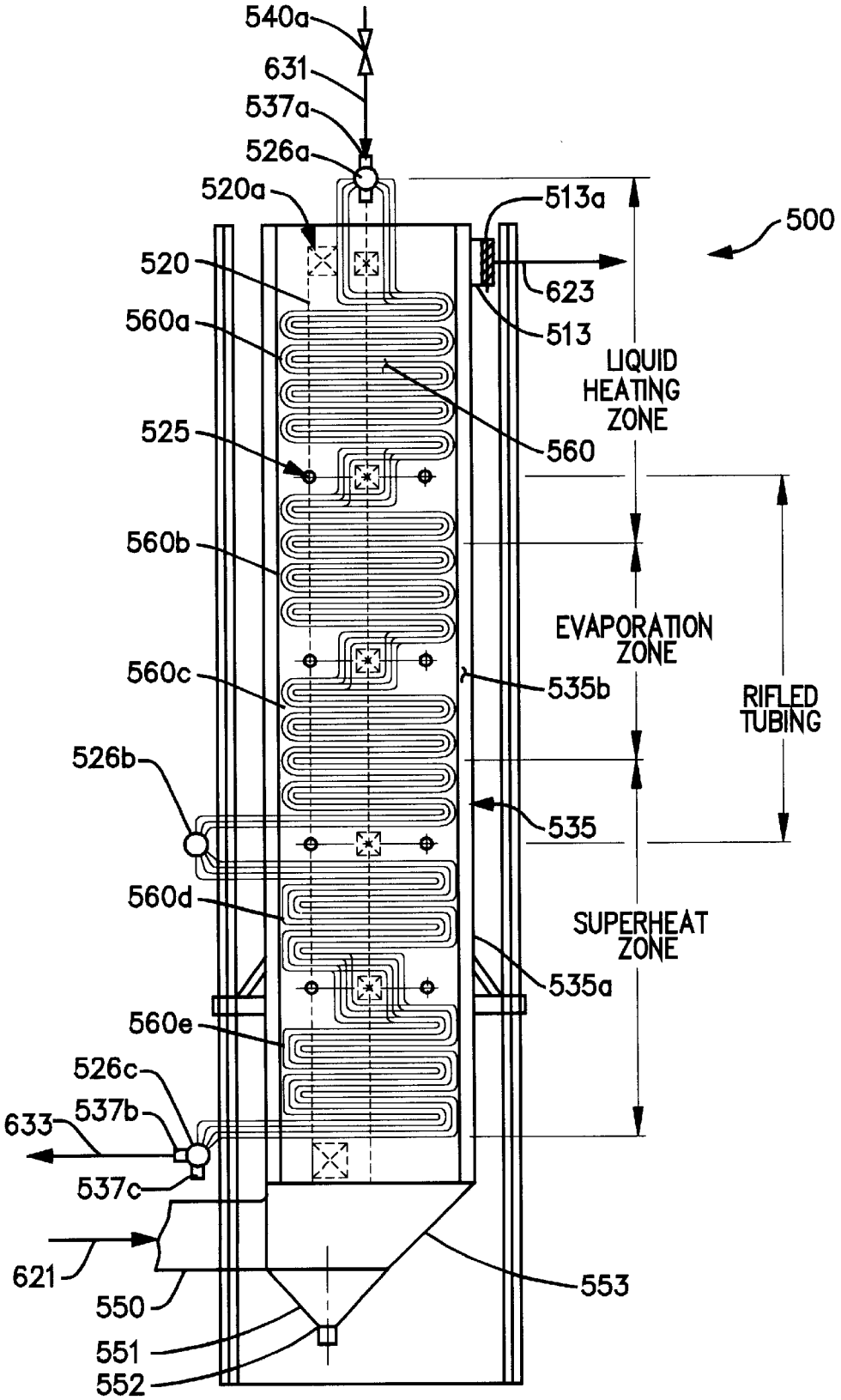
FIG. 5 depicts a waste heat recovery system according to a first embodiment of the present invention.

FIG. 5 illustrates an embodiment of a single pressure binary working fluid waste heat recovery system 500, according to the present invention. The system 500 is particularly suitable for operation with an ammonia/water working fluid of the type utilized in a Kalina cycle, but could be easily modified to operate with other binary or multi-component working fluids.

The system 500 includes modular serpentine tubular heat transfer surface sections 560*a*–560*e*. In the particular exemplary embodiment shown, the heat transfer surfaces of section 560*a* form a preheater for preheating the liquid working fluid fed to the system. The heat transfer surfaces of sections 560*b*–560*c* form a boiler for vaporizing the preheated working fluid output from the preheater. The heat transfer surfaces of sections 560*d*–560*e* form a superheater for superheating the vaporized working fluid output from the boiler.

The heat transfer surfaces 560*a*–560*e* are formed of flow tubes 560 which serve as flow paths for transporting the binary working fluid such that heat is transferred to transform the liquid feed fluid into a high temperature high pressure vapor capable of driving a turbine to produce electrical power. The tubes 560 form continuous parallel flow paths for the working fluid between the working fluid feed header 526*a* and the equalization header 526*b*, and between the equalization header 526*b* and the working fluid outlet header 526*c*. The continues flow paths provide for once-through downward flow of the working fluid. The downward meandering or serpentine path of the tubes 560 provides for a completely drainable arrangement. The tubes 560 are beneficially made of carbon or austenitic steel when the working fluid is a binary mixture of ammonia and water. Preferably, austenitic steel is employed for at least the lower, i.e., hottest, portion of the superheater tubing forming heat transfer surfaces 560*d*–560*e*.

Liquid working fluid 631 enters the system 500 through an inlet port 537*a* of feed header 526*a*. The feed binary working fluid preferably originates at the DCSS and/or RHE of a Kalina cycle power generation system of the type described in FIGS. 1–4, and hence is mineral free. A valve 540*a* can be used to control the flow rate of the feed fluid to the inlet heater 526*a*. Gravity forces the liquid working fluid to flow vertically downward through the tubes 560 of heat transfer surface sections 560*a*–560*c* to the equalization header 526*b*. During normal operations, the liquid is fully vaporized prior to entering the header 526*b*, and may even be somewhat superheated.

Gravity then forces the vapor working fluid to flow vertically downward from the header 526*b* through the tubes 560 of heat transfer surface sections 560*d*–560*e* to the outlet header 526*c*. The vapor is superheated prior to entering the header 526*c*. The superheated vapor egresses from the header 526*b* via outlet port 537*b* and is directed to a vapor turbine of the type described above (not shown).

Working fluid which is preheated, vaporized and superheated in continuously heated parallel flow paths may be subject to imbalances due to flue gas velocity and temperature imbalances. This in turn can result in unstable system operation, particularly if a large temperature gradient develops between different parallel circuits, i.e., a working fluid which is overheated in some of the parallel tubes is insufficient to compensate for working fluid which is underheated in other of the parallel tubes. The possibility of excessive temperature gradients increases as the length of the tubes increase, particularly the tubes in the superheater. To reduce the possibly of such an occurrence equal inlet flow to each of the tubes needs to be maintained. Accordingly, orifices are located at the connection of each of the tubes 560 to the inlet header 526*a* to ensure approximately equal flow to each tube taking into account the tubes inner surface roughness, inner diameter deviations, inlet and outlet header connection configurations and geometry, and anticipated flue gas imbalances.

Because the heat transfer surface sections 560*d*–560*e* forming the superheater are subjected to the hottest flue gasses, these sections will be most heavily influenced by imbalances in the flue gas flow rate and/or temperature. By separating the heat transfer surface sections 560*d*–560*e*, which form the superheater, from the heat transfer surface sections 560*a*–560*c*, which form the preheater/boiler, these potential imbalances can, in most if not all cases, be accommodated without substantially affecting the overall system performance of the preheater and the evaporator heat transfer surface sections 560*a*–560*c*.

More particularly, equalization header 526*b* receives the vaporized working fluid from the heat transfer surface section 560*c*, which is the last of the sections performing evaporative duty in the embodiment of FIG. 5. The temperature and pressure of the received vapor is normalized in the header 526*b* before being distributed to the respective tubes of heat transfer surface section 560*e*, which is the first of the heat transfer sections performing superheat duty. The normalization performed by the equalization header 526*b* ensures that the vapor fed to the respective tubes 560 of the higher temperature heat transfer surface sections 560*d* and 560*e* is of substantially equal pressure and temperature. This in turn ensures a more consistent transfer of heat to the working vapor in sections 560*d*–560*e* and hence a more homogeneous superheated vapor entering the outlet header 526*c* from the flow tubes 560 of the heat transfer surface section 560*e*. Additionally, the inclusion of header 526*b* reduces the pressure loss requirements of the inlet orifices in header 526*a*.

The heat transfer surfaces 560*a*–560*e* are stacked vertically inside a flue gas transport box or duct 535 which is formed of a sheet metal outer skin 535*a* and an insulating refractory 535*b* lining the inside surface of the outer skin 535*a*. If waste heat flue gas is not ladened with particulate matter, the refractory 535*b* can be replaced by an insulation layer lining the outside surface of the outer skin 535*a*. Hot waste heat gasses 621 are directed from a vapor generator, gas turbine or other waste heat source (not shown), to the system 500. The waste heat gasses enter the system 500 via the gas inlet duct 550 which is connected to a lower portion of the flue gas duct 535 by a plenum duct 553. It should be noted that, preferably, the waste heat flue gases enter the system below the heat transfer surface sections 560*a*–560*e*. The waste heat flue gases rise from the bottom of the flue gas duct 535, passing between the flow tubes 560, thereby transferring heat to the working fluid.

Because of the vertically stacked configuration of the heat exchange surfaces in superheater sections 560*d*–560*e* and preheater/evaporator sections 560*a*–560*c*, a cyclonic flue gas flow is achieved throughout heat recovery system 500. This cyclonic flue gas flow results in a greater amount of particulate matter, if present, being separated from the waste heat gas stream. Hence, the particulate matter within the flue gas is continuously reduced as it rises through flue gas duct 535. This in turn minimizes the possibility of particulate blockage of the gas flow between the tubes, thus ensuring optimum heat transfer between the flue gas and the working fluid. This also reduces the particulate matter in the flue gas exhausted from the system.

Sootblowers 525 are optionally provided to remove accumulated particulate matter from the outer surfaces of the tubes 560. A hopper 551 is also optionally provided to collect particulate matter which is separated from the flue gas stream during its flow between the gas inlet duct 550 and gas outlet duct 513. A hopper outlet 552 is provided for removal of the particulate matter from the hopper 551.

The gas stream egresses from the system via flue gas outlet duct 513 as exhaust gas 623. An outlet damper 513*a* controls the flow of the exhaust gas from the system. The exhaust gas 623 is directed by additional ducting (not shown) from the outlet 513 to a smokestack for release into the atmosphere. Prior to entering the smokestack, the exhaust gas may be routed to, for example, scrubbers or other types of particulate removal mechanism to further remove particulate matter or other environmental detrimental material from the exhaust gas before the exhaust gas is released into the atmosphere. Gas inlet duct 550 and gas outlet duct 513 may be connected to the flue gas duct 535 by expansion joints (not shown), to compensate for differential thermal expansion and external duct loading.

As noted above, the waste heat gasses 621 enter the system via inlet 550 located at or near the bottom of the system while the feed working fluid enters the system at the upper system header 526*a*. Hence, the flue gasses flow counter to the flow of the working fluid, i.e., the flue gasses flow vertically upward while the working fluid flows vertically downward. Those of the heat transfer surface sections which have higher temperature duty requirements, i.e., 560*d*–560*e*, are located at the lower region within vertical heat recovery system 500. Further, the tubes forming the heat transfer surfaces are arranged such that the working fluid does not recirculate within the system, i.e., in a once through system configuration. Using this arrangement more efficient management of heat transfer can be accomplished.

More particularly, this arrangement provides a minimum temperature differential between the flue gas and the working fluid, i.e., where the flue gas is the hottest, the working fluid is the hottest and visa versa. Accordingly, the temperature profile of the working fluid parallels that of the flue gas for the system as a whole. Further, because the binary working fluid boils at varying temperatures, unlike in a Rankine cycle, the temperature profile of the working fluid also parallels that of the flue gas within the boiler. Additionally, by using a once through tube arrangement, separator drums and related piping otherwise necessary to recirculate the working fluid through the boiler are eliminated and boiling can occur at the lowest possible temperature. Moreover, ribbed tubing, commonly referred to as rifled tubing, as will be described in detail below, is used in the portion of the tubes forming the boiler to ensure isothermal boiling. Spiral fins, as will be described in detail below, are also provided to enhance the heat transfer area of the tube. By utilizing these features, the amount of tubing within sections 560*a*–560*e*, and thus for the overall system tubing, can be minimized, and near optimum system efficiency can be achieved without varying the pressure of the working fluid, i.e., using working fluid at a substantially constant pressure. Further, because of the once through system configuration, the point within the system at which full vaporization occurs can be varied.

As will be recognized by those skilled in the art, in the once through type system of FIG. 5, boiling could occur under various flow regimes, particularly if ribbed tubing is not used in the boiler area. That is, boiling will initially occur on the tube inner surface under isothermal, i.e., fully wetted, conditions but could later occur under non-isothermal, i.e., non-fully wetted, conditions. The former results in extremely high heat transfer coefficients while the latter results in extremely low heat transfer coefficients and the possible deposit of water soluble salts from the working fluid where dry-out occurs on the tube inner surface. By using distilled liquid feed working fluid from the DCSS and/or RHE of a Kalina type system, this potential problem is eliminated since mineral free working fluid is delivered to the system.

The rate of flow of the binary fluid through the system can be controlled by adjusting valve 540*a*. By controlling the rate of flow of the working feed fluid at the inlet port 537*a* using valve 540*a*, the temperature of the superheated vapor leaving the output port 537*b* can be varied. A slow rate of flow will allow more time for the binary fluid to absorb heat resulting in a higher temperature vapor, and correspondingly a rapid rate of flow will allow less time for the binary fluid to absorb heat resulting in a lower temperature vapor. Further, by adjusting valve 540*a* in relationship with changes in the flow rate, temperature or other characteristics of the flue gas 633 entering the system or the characteristics of the feed fluid 631 entering the system, a constant vapor temperature at the output port 537*b* can be maintained even if the characteristics of the flue gas or feed fluid change during operation of the system.

Further, by modulating the degree of opening of outlet damper 513*a* the rate of flow of the flue gas can be regulated thereby controlling the heat exchange occurring in the system 500. That is, by controlling the rate of flow of the flue gas at the outlet duct 513 using damper 513*a*, the temperature of the superheated vapor leaving the output port 537*b* can be varied. A fast rate of flow of the flue gas will result in more heat being transferred to the binary fluid and a higher temperature vapor at outlet port 537*b*, and correspondingly a slower rate of flow will result in less heat being absorbed by the binary fluid and thus a lower temperature vapor. Alternatively, by adjusting damper 513*a* in relationship with changes in temperature or other characteristics of the flue gas 633 entering the system or the rate of flow or other characteristics of the feed fluid 631 entering the system, a constant vapor temperature at the output port 537*b* can be maintained even if the characteristics of the flue gas or feed fluid change during operation of the system.

Further control of the heat transfer to the working fluid may be accomplished by inclusion of an optional bypass duct 520 which may vent a portion of the gas flow 621 completely around heat transfer surface sections 560*a*–560*e*. The bypass duct 520 also includes a damper 520*a* for controlling the amount of flue gas vented through duct 520. The damper 520*a* may be a simple device which operates only to open and close the duct, or could be a fully adjustable damper. The bypass duct 520 can, for example, be opened during off-load or upset conditions, to manipulate the cycle heat input and thereby control the temperature of the superheated vapor output from the port 537*b*. Hence, by adjusting damper 520*a* of bypass duct 520 in relationship with changes in the system load requirements, flue gas or working fluid characteristics, the temperature of the superheated vapor can be changed or held constant at output port 537*b*, as may be desired under the circumstances.

As shown, the vertical heat recovery unit 500 is further provided with a valve drainage port and valve 537*c* at the bottom of header 526*c*. This allows the vertically stacked banks of tubes 560 forming the preheater, boiler and superheater, i.e., heat transfer surface sections 560*a*–560*e* to be fully drained during down periods providing an important measure against corrosion and facilitating maintenance.

The respective heat transfer surface sections and associated sections of duct 535 may be fabricated as independent modules. This modular construction of superheater sections 560*d*–560*e* and preheater/evaporator sections 560*a*–560*c* facilitates shipment to the field installation site, allows increased erection spans and facilitates quick and easy field installation, with minimized field labor required. This greatly reduces construction costs and time.

Figure 6A:
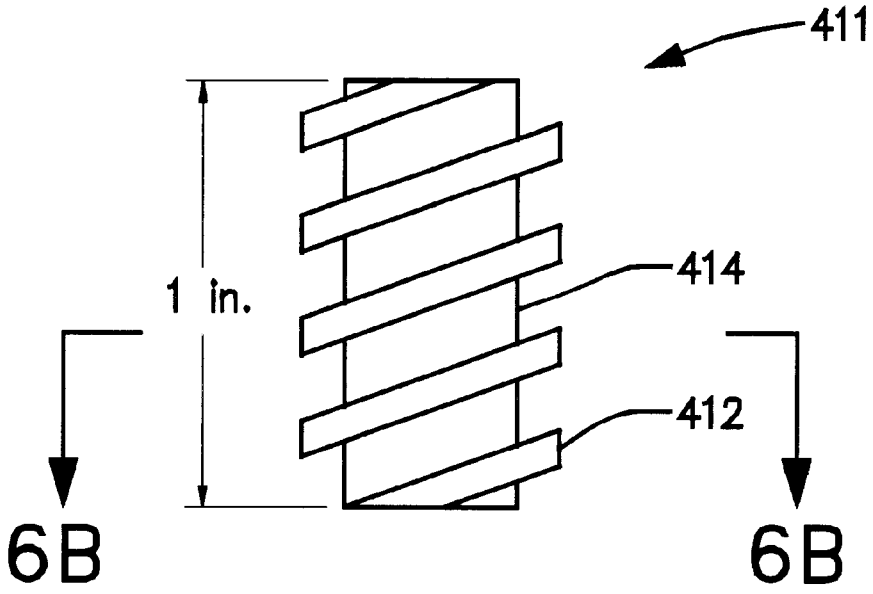
FIG. 6A depicts a heat transfer tube having an extended heat transfer surface according to the present invention.
Figure 6B:
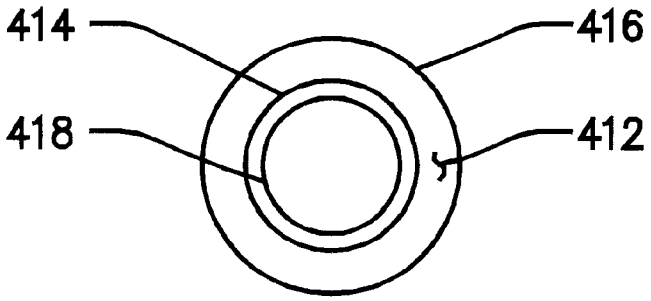
FIG. 6B depicts a sectional view of the heat transfer tube depicted in FIG. 6A.

FIG. 6A shows a 1" length of one of the tubes 560 forming the heat transfer surface sections 560*a*–560*e*. The tube section is identified with reference numeral 411. Preferably, the 1" tube section 411 has 5 spirals formed by the fin 412 which extends the tube 560 of which section 411 forms a portion. In the preferred embodiment of FIG. 5, each of the tubes 560 is as represented by section 411. The density of the extended spiral fin 412, i.e., the closeness of the respective spirals, is selected to correspond to the quantity and composition of particulate matter within the hot gas. Typically the greater the quantity of particulate matter in the flue gas the closer will be spirals. As shown in FIG. 6B, exemplary section 411 has an inner surface 418 having a diameter of 0.75 inches and an outer surface 414 having a diameter of 2 inches. A typical fin 412 is shown with a dimension of 0.6 inches projecting outward from the outer surface of the tube creating an extended outer surface 416 having a diameter of 2.6 inches. As will be understood by those skilled in the art, the selection of tubing pitch, flue gas velocity, and soot-blower requirements are also dependent on the quantity and composition of the particulate in the flue gas.

Figure 7B:
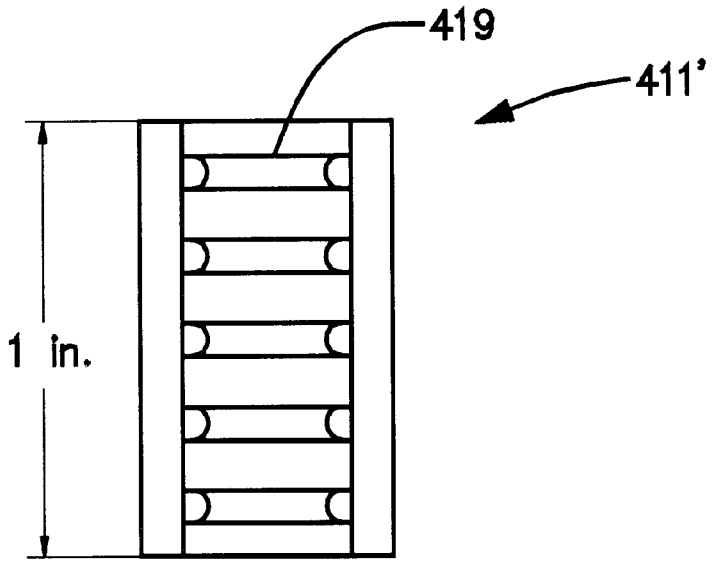
FIG. 7B depicts a sectional view of the heat transfer tube depicted in FIG. 7A.
Figure 7A:
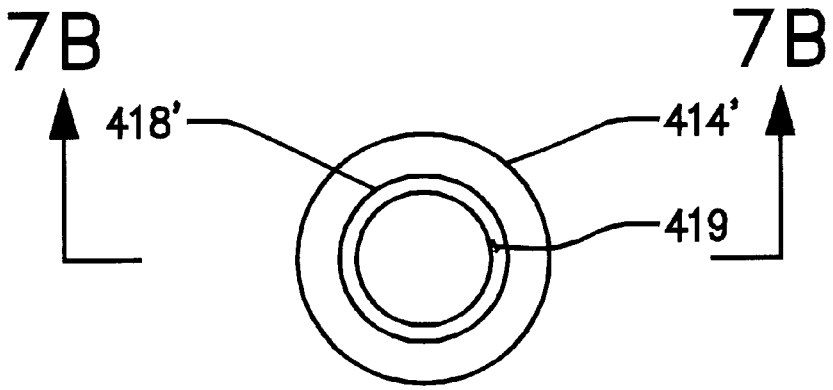
FIG. 7A depicts a heat transfer tube having a ribbed inner surface according to the present invention.

FIG. 7A illustrates another section 411' of any one of the tubes 560 forming heat transfer surface sections 560*b*–560*c*, i.e., those heat transfer surface sections where the working fluid will be vaporized. The tubing 411' has a rib 419 on its inside diameter surface 418' to ensure isothermal boiling. The outside surface of the tube is identified by the reference numeral 414'. Perfectly, fins 412, as shown in FIGS. 6A and 6B, are attached to the tube 411' prior to installation.

FIG. 7B illustrates a cross sectional view of the tube section 411' shown in FIG. 7A. As shown, the ribbed surface 419 is formed so as to promote a swirling of the working fluid as it flows within the tube. This action maintains a wetted inside tube surface and hence isothermal boiling within the boiler, i.e., sections 560*b*–560*c*. As discussed above, this in turn ensures a high heat transfer coefficient and lowers the required installed tube length within the boiler sections. The ribbed tubing further reduces the working fluid velocity within the tube and consequently reduces fluid side pressure loss.

Figure 8:
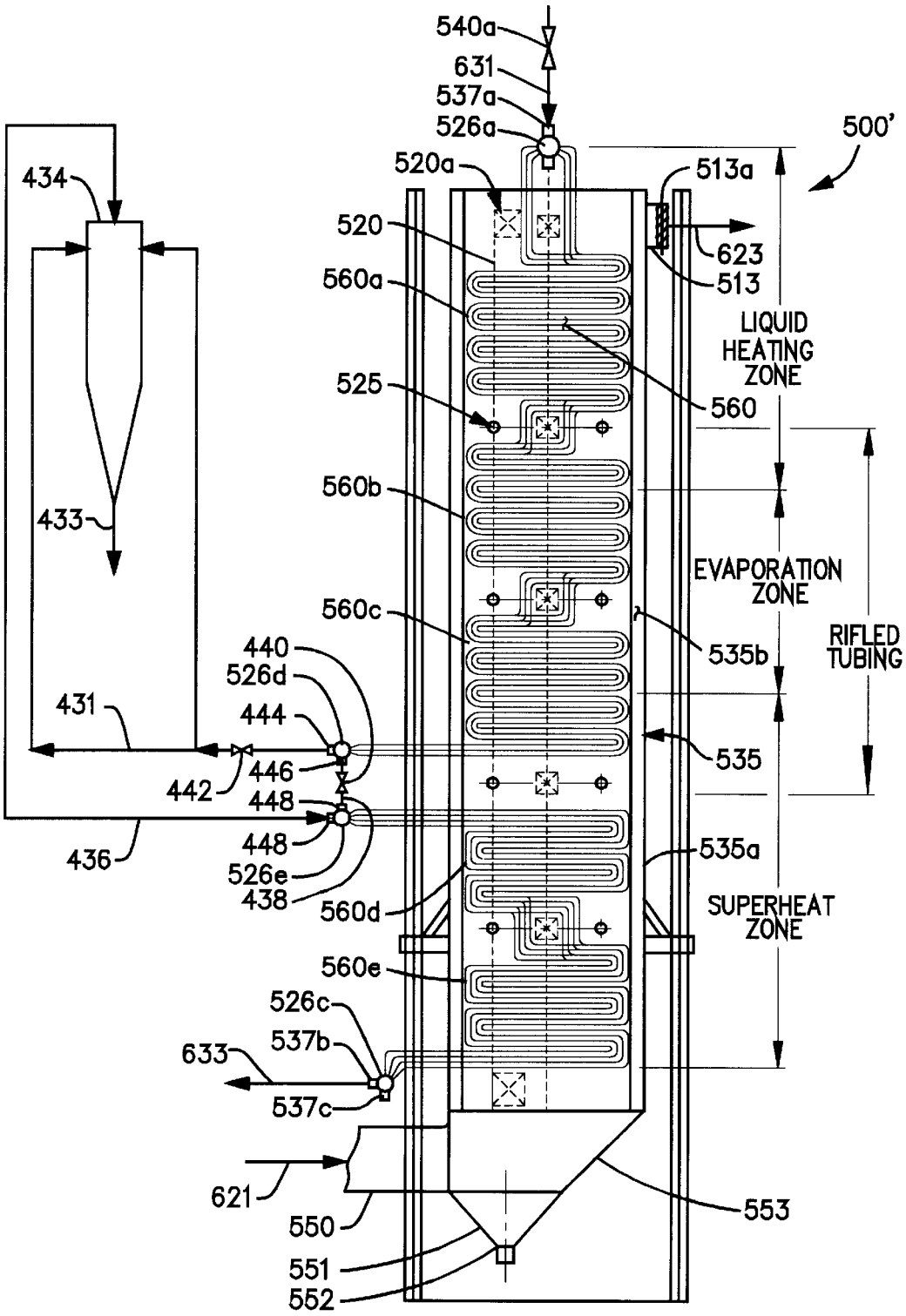
FIG. 8 depicts a second embodiment of a waste heat recovery system according to the present invention.

FIG. 8 shows a vertical heat recovery system 500' which is identical to the vertical heat recovery system 500 of FIG. 5, except for the inclusion of a dedicated start-up/upset condition separator 434. In order to accommodate the separator 434, two headers, i.e., an upper header 526*d* arid a lower header 526*e*, replace the pressure equalization header 526*b* of the system shown in FIG. 5. The upper header 526*d* is located at the outlet of the preheater/boiler, i.e., heat transfer surface sections 560*a*–560*c*, which as discussed above performs preheating, evaporating, and perhaps a small quantity of superheating during normal operations. The lower header 526*e* is located at the inlet of the primary superheater, i.e., heat transfer surface sections 560*d*–560*e*.

During normal operation, the separator 434 could, if desired, receive the dry vapor from the header 526*d* and pass it to the header 526*e*. Optionally, a flow path 438 can be provided between header 526*d* and 526*e*. If so, during normal operations, valve 442 is shut to block the flow from header 526*d* to separator 434 via header port 444, and valve 440 is opened to allow the flow from header 526*d* to the header 526*e* via header ports 446 and 448.

During start-up and upset conditions, the upper heat transfer surface sections 560*a*–560*c* transform the received liquid feed working fluid 631 into a two phase working fluid which is collected in drum 562*d* and directed via port 444 to separator 434 as fluid stream 431. If the optional flow path 438 is provided, valve 442 is opened to allow the flow from header 526*d* to the separator 434 via header port 444 and valve 440 is closed to block the flow from header 526*d* to the header 526*e* via header ports 446 and 448. The separator 434 separates the two phase fluid stream 431 from the header 526*d* into a vapor stream 436 which is delivered to the lower header 526*e*, and a liquid stream 433 which could, for example, be delivered to the DCSS/RHE of the Kalina system (not shown).

Figure 9:
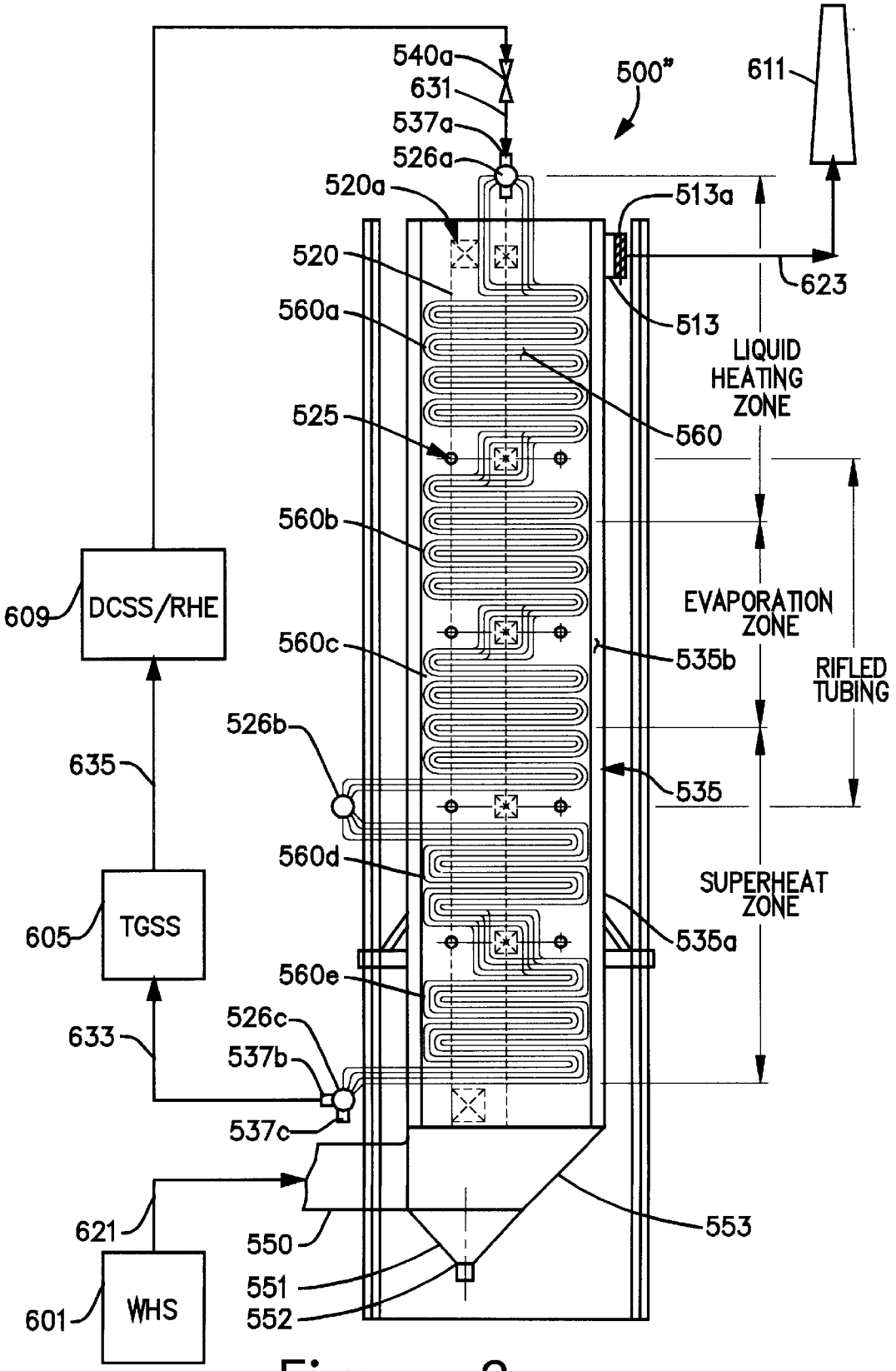
FIG. 9 depicts a waste heat power generating system, having the waste heat recovery system of FIG. 5, in accordance with the present invention.

FIG. 9 shows a Kalina Cycle power generation system 500" which includes a vertical heat recovery system, which is identical to the system 500 of FIG. 5, and a waste heat source (WHS) 601, a TGSS 605, and a DCSS/RHE 609. The TGSS 605 and DCSS/RHE 609 are similar to the TGSS 130 and the DCSS and RHE of the RSS 150 described in the Kalina cycle system of FIGS. 1–4.

The WHS 601 generates hot gases 621. The hot exhaust gases 621 from the WHS 601 are directed through a vertical heat recovery system where heat from the hot gases transfers to a binary working fluid 631 received from the DCSS/RHE 609. The expended gases 623 are then released to the atmosphere through smokestack 611.

Binary working fluid 631 enters the vertical heat recovery system at inlet port 537*a* in a liquid state, passes through the heater transfer surface sections 560*a*–560*e* and exits outlet port 537*b* as a superheated vapor 633. The superheated vapor 633 passes through TGSS 605 wherein the vapor is expanded to produce electrical power. Expanded vapor stream 635 which is provided as an output from the TGSS 605 then enters the DCSS/RLIE 609 where the vapor stream 635 is used in the regenerative process to transfer heat to other multicomponent working fluid as described with reference to FIG. 1–4 above. During this regenerative process the expanded vapor is cooled and ultimately condensed back to a liquid state, thus completing the Kalina cycle. This condensed working fluid forms at least a part of the multicomponent working fluid stream 631.

It should be noted that the condensed liquid from DCSS/RHE 609 will be low in minerals because of the distillation which occurs during the regenerative processing. It will also be recognized that numerous modifications to the above described system are conceivable. For example, the waste heat used to heat the binary fluid may be taken from a heat source, such as a gas turbine and, if so, the hopper can be eliminated since only clean hot gas, i.e., hot gas which is low in particulate matter, will flow through the transport duct 535. It will further be understood that the Kalina cycle system 500" may include additional turbines, reheaters, heat exchanges and other components.

Figure 10:
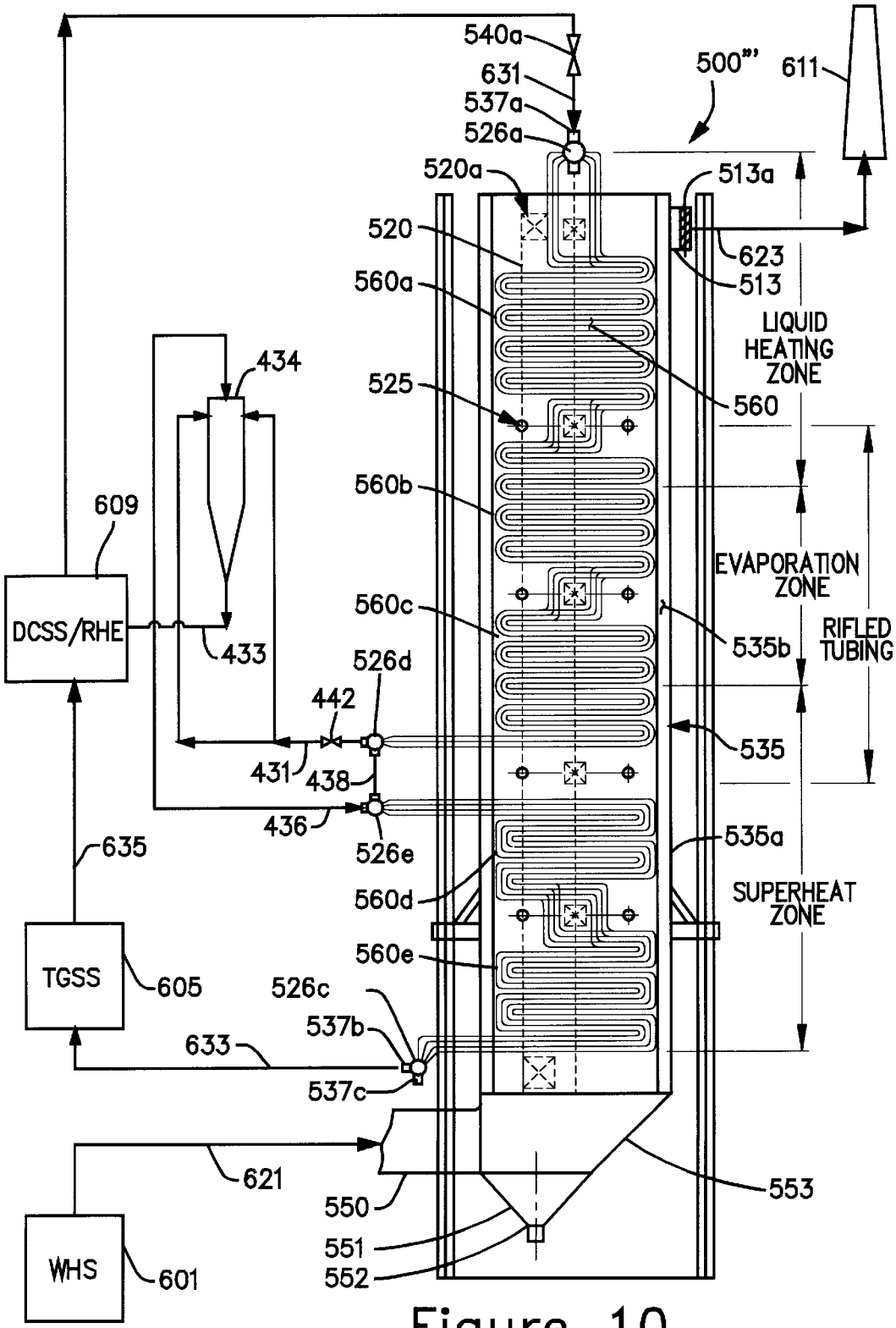
FIG. 10 illustrates a waste heat power generation system, having the waste heat recovery system of FIG. 8, in accordance with the present invention.

FIG. 10 shows a Kalina Cycle power generation system 500'" which includes a vertical heat recovery system as shown in FIG. 8, a WHS 601, a TGSS 605, and a DCSS/RHE 609. During normal operations, the system of FIG. 10 performs in the same manner as the system described in FIG. 9. However, in the start-up/upset mode of operation, the upper heat transfer surface sections 560*a*–560*c* produce a two phase fluid stream 431 consisting of a vapor component and a liquid component. The separator 434 separates the fluid stream 431 into the vapor stream 436 which is delivered to the lower header 526*e*, and the liquid stream 433 which is delivered to DCSS/RHE 609. The stream 433 delivered to the DCSS/RHE 609 provides heat for the regenerative process. The stream 433 delivered to the DCSS/RHE is cooled by a transfer of heat to other multicomponent working fluid and any excess heat is rejected via the condenser of the DCSS/RHE. The cooled working fluid from stream 433 is then fed to the header 526*a* via inlet port 537*a* as all or part of the working fluid feed supply stream 631. The main feed pump in the DCSS/RHE can, if desired, be used as a recirculation pump for this purpose.

As described above, the present invention provides a technique for more efficiently recovering waste heat by using a non-Rankine heat transfer cycle. Using the invention, the heat transfer characteristics of waste heat recovery systems can be substantially improved. Described aspects of the present invention facilitate the recovery of waste heat from an exhaust gas which is high in particulate matter, accommodate heat transfer imbalances and changes in the waste heat characteristics, reduce the required total heat transfer surface, facilitate start-up and low load operations, and allow the temperature of a heat transfer fluid to be easily controlled. Other aspects of the invention simplify system shipment to and installation at a field site, and simplify maintenance and operation requirements.

It will also be recognized by those skilled in the art that, while the invention has been described above in terms of one or more preferred embodiments, it is not limited thereto. Various features and aspects of the above described invention may be used individually or jointly. Further, although the invention has been described in the context of its implementation in a particular environment and for particular purposes, e.g., waste heat recovery, those skilled in the art will recognize that its usefulness is not limited thereto and that the present invention can be beneficially utilized in any number of environments and implementations. Accordingly, the claims set forth below should be construed in view of the full breath and spirit of the invention as disclosed herein.

We claim:

1. A waste heat recovery system, comprising:

a chamber;

a gas inlet configured to direct a flow of hot gas from a waste heat source to the chamber;

a gas outlet configured to direct the flow of hot gas from the chamber;

a working fluid inlet port configured to direct a flow of multicomponent working fluid to the chamber;

a working fluid outlet port configured to direct the flow of multicomponent working fluid from the chamber;

a plurality of heating surfaces disposed within the chamber and formed of tubes configured to transport the flow of multicomponent working fluid from the inlet port to the outlet port such that the flow of the hot gas from the gas inlet to the gas outlet transfers heat from the hot gas to the flow of multicomponent working fluid.

2. The waste heat recovery system of claim 1, wherein:

the tubes are further configured to transport the flow of multicomponent working fluid from the inlet port to the outlet port at a substantially constant pressure.

3. The waste heat recovery system of claim 1, wherein: the multicomponent working fluid is a binary mixture.

4. The waste heat recovery system of claim 3, wherein: the binary mixture is a mixture of ammonia and water.

5. The waste heat recovery system of claim 1, wherein:

the waste heat source is one of a gas turbine and a vapor generator.

6. The waste heat recovery system of claim 1, wherein:

the tubes form a preheater for preheating the flow of multicomponent working fluid from the inlet port, a boiler for vaporizing the flow of preheated multicomponent working fluid from the preheater, and a superheater for superheating the flow of vaporized multicomponent working fluid from the boiler;

the tubes forming the preheater are positioned at a higher elevation in the chamber than the tubes forming the boiler; and the tubes forming the boiler are positioned at a higher elevation in the chamber than the tubes forming the superheater.

7. The waste heat recovery system of claim 1, further comprising:

a damper configured to adjust the rate of flow of hot gas within the chamber.

8. The waste heat recovery system of claim 7, wherein adjustment of the rate of flow of hot gas within the chamber controls a temperature of the multicomponent working fluid at the working fluid outlet port.

9. The waste heat recovery system of claim 7, wherein the damper is disposed proximate to the gas outlet.

10. The waste heat recovery system of claim 1, further comprising:

a valve configured to adjust the rate of flow of multicomponent working fluid in the tubes.

11. The waste heat recovery system of claim 10, wherein adjustment of the rate of flow of multicomponent working fluid in the tubes controls a temperature of the multicomponent working fluid at the working fluid outlet port.

12. The waste heat recovery system of claim 10, wherein the valve is disposed proximate to the inlet port.

13. The waste heat recovery system of claim 1, wherein:

the multicomponent working fluid is received at the input port;

the tubes are further configured to transport the received multicomponent working fluid between the inlet port and the outlet port only once; and the transfer of heat from the hot gas to the received multicomponent working fluid fully vaporizes the multicomponent working fluid.

14. The waste heat recovery system of claim 1, wherein:

the flow of hot gas within the chamber is in a first general direction;

the flow of multicomponent working fluid is in a second general direction; and the second general direction is counter to the first general direction.

15. The waste heat recovery system of claim 14, wherein:

the flow of hot gas within the chamber is in a generally upward direction; and the flow of multicomponent working fluid is in a generally downward direction.

16. The waste heat recovery system of claim 1, wherein:

the gas inlet is disposed proximate to the working fluid outlet port and distal to the working fluid inlet port; and the gas outlet is disposed proximate to the working fluid inlet port and distal to the working fluid outlet port.

17. The waste heat recovery system of claim 1, wherein:

the gas inlet is at an elevation lower than the gas outlet; and the working fluid outlet port is at an elevation lower than the working fluid inlet port.

18. The waste heat recovery system of claim 1, wherein:

the tubes are configured to meander between the working fluid inlet port and the working fluid outlet port.

19. The waste heat recovery system of claim 18, wherein:

the tubes meander such that a substantial portion of each of the tubes has a substantially horizontal disposition.

20. The waste heat recovery system of claim 18, wherein the tubes meander so as to be completely drainable.

21. The waste heat recovery system of claim 1, further comprising:

a drainage port; and a valve for controlling a drainage flow of the multicomponent working fluid at the drainage port;

wherein the tubes are completely drainable by operating the valve to provide the drainage flow.

22. The waste heat recovery system of claim 1, wherein the tubes include first tube segments and second tube segments and the transfer of heat from the flow of hot gas to the flow of multicomponent working fluid vaporizes the multicomponent working fluid transported by the first tube segments and superheats the vaporized multicomponent working fluid transported by the second tube segments, and further comprising:

a header configured to collect the vaporized multicomponent working fluid from the first tube segments prior to the vaporized multicomponent working fluid being transported by the second tube segments.

23. The waste heat recovery system of claim 22, wherein the header is further configured to equalize at least one of a pressure and a temperature of the vaporized multicomponent working fluid collected from the first tube segments.

24. A waste heat recovery system, comprising:

a chamber;

a gas inlet configured to direct a flow of hot gas from a waste heat source to the chamber;

a gas outlet configured to direct the flow of hot gas from the chamber;

a working fluid inlet port configured to direct a flow of multicomponent working fluid to the chamber;

a working fluid outlet port configured to direct the flow of multicomponent working fluid from the chamber;

a plurality of heating surfaces disposed within the chamber and formed of tubes configured to transport the flow of multicomponent working fluid from the inlet port to the outlet port such that the flow of the hot gas from the gas inlet to the gas outlet transfers heat from the hot gas to the flow of multicomponent working fluid;

wherein each of the tubes has an internal rib.

25. The waste heat recovery system of claim 24, wherein:

the multicomponent working fluid is vaporized within a portion of each of the tubes; and the rib is disposed within the portion of each tube in which the multicomponent working fluid is vaporized.

26. The waste heat recovery system of claim 1, wherein at least one portion of each of the tubes is formed of one of carbon steel and austenitic steel.

27. The waste heat recovery system of claim 26, wherein:

the at least one portion of each of the tubes is formed of austenitic steel; and the multicomponent working fluid transported in the at least one portion of each of the tubes is superheated by the transfer of heat.

28. The waste heat recovery system of claim 1, wherein:

the chamber includes a surface configured to contact hot gas flowing within the chamber; and the surface is formed of an insulating refractory material.

29. The waste heat recovery system of claim 1, further comprising:

a by-pass chamber configured to direct another flow of hot gas from the waste heat source;

wherein the other flow of hot gas flows outside the chamber.

30. The waste heat recovery system of claim 29, further comprising:

a damper operable to control an amount of the hot gas from the waste heat source which is directed by the by-pass chamber.

31. The waste heat recovery system of claim 30, wherein the amount of the hot gas directed by the by-pass chamber is controllable to control a temperature of the multicomponent working fluid at the working fluid outlet port.

32. The waste heat recovery system of claim 30, wherein the amount of the hot gas directed by the by-pass chamber is controllable such that the hot gas concurrently flows within the chamber and outside the chamber.

33. The waste heat recovery system of claim 1, wherein the tubes include first tube segments and second tube segments, and further comprising:

a separator configured to receive the flow of multicomponent working fluid from the first tube segments, to separate the received flow of multicomponent working fluid into a vaporized multicomponent working fluid and a liquid multicomponent working fluid;

wherein only the vaporized multicomponent working fluid is transported by the second tube segments.

34. The waste heat recovery system of claim 33, further comprising:

a valve configured to control the flow of multicomponent working fluid to the separator;

wherein the valve is operable such that the flow of multicomponent working fluid to the separator is allowed in a first mode of operation and blocked in a second mode of operation.

35. The waste heat recovery system of claim 34, wherein the second mode of operation is a normal operating mode.

36. The waste heat recovery system of claim 34, wherein the first mode of operation is a start-up mode.

37. The waste heat recovery system of claim 33, further comprising:

a first header configured to collect the multicomponent working fluid from the first tube segments;

a first header port configured to direct a flow of the collected multicomponent working fluid to the separator;

a second header configured to collect the vaporized multicomponent working fluid from the separator;

a second header port configured to direct a flow of the collected vaporized multicomponent working fluid to the second tube segments.

38. The waste heat recovery system of claim 37, further comprising:

a third header port configured to direct another flow of the multicomponent working fluid collected by the first header to the second header;

a first valve operable to block the flow of collected multicomponent working fluid to the separator in a first mode of operation; and a second valve operable to block the other flow of collected multicomponent working fluid to the second header in a second mode of operation;

wherein the second header collects the vaporized multicomponent working fluid from the separator in the second mode of operation and collects the other flow of multicomponent working fluid from the first header in the first mode of operation.

39. The waste heat recovery system of claim 33, wherein the transfer of heat from the flow of hot gas to the flow of multicomponent working fluid at least partially vaporizes the multicomponent working fluid transported by the first tube segments and superheats the vaporized multicomponent working fluid transported by the second tube segments.

40. The waste heat recovery system of claim 1, wherein the tubes include:

a module of first tube segments configured to preheat the flow of multicomponent working fluid from the inlet port, a module of second tube segments configured to vaporize the flow of preheated multicomponent working fluid from the preheater, and a module of third tube segments configured to superheat the flow of vaporized multicomponent working fluid from the boiler.

41. The waste heat recovery system of claim 1, wherein the flow of multicomponent working fluid directed from the chamber is a flow of superheated multicomponent working fluid, and further comprising:

a turbine configured to receive the flow of superheated multicomponent working fluid and to expand the received superheated multicomponent working fluid to generate power; and a regenerative subsystem configured to receive the expanded multicomponent working fluid and to cool the expanded multicomponent working fluid by transferring heat from the expanded multicomponent working fluid to other multicomponent working fluid, the cooled multicomponent working fluid forming at least a part of the flow of multicomponent working fluid directed to the chamber.

42. The waste heat recovery system of claim 1, wherein the tubes include first tube segments and second tube segments, and further comprising:

a turbine configured to receive the flow of multicomponent working fluid directed from the chamber and to expand the received multicomponent working fluid to generate power;

a separator configured to receive the multicomponent working fluid from the first tube segments, to separate the received multicomponent working fluid into a vaporized multicomponent working fluid and a liquid multicomponent working fluid; and a regenerative subsystem configured to receive the expanded multicomponent working fluid and the liquid multicomponent working fluid, and to cool the expanded and the liquid multicomponent working fluid by transferring heat from the expanded and the liquid multicomponent working fluid to other multicomponent working fluid, the cooled multicomponent working fluid forming a part of the flow of multicomponent working fluid directed to the chamber; and wherein only the vaporized multicomponent working fluid is transported by the second tube segments.

43. A method of recovering waste heat, comprising the steps of:

directing a flow of the hot gas from a waste heat source;

directing a flow of a multicomponent working fluid to transfer heat from the flow of hot gas to the flow of multicomponent working fluid.

44. The waste heat recovery method of claim 43, further comprising the step of:

maintaining the flow of multicomponent working fluid at a substantially constant pressure.

45. The waste heat recovery method of claim 43, wherein:

the multicomponent working fluid is a binary mixture.

46. The waste heat recovery method of claim 45, wherein:

the binary mixture is a mixture of ammonia and water.

47. The waste heat recovery method of claim 43, wherein:

the hot gas is substantially free of particulate matter.

48. The waste heat recovery method of claim 43, wherein:

the transfer of heat from the flow of hot gas to the flow of multicomponent working fluid preheats the flow of multicomponent working fluid, vaporizes the flow of preheated multicomponent working fluid, and superheats the flow of vaporized multicomponent working fluid as the flow of working fluid is directed downward.

49. The waste heat recovery method of claim 43, further comprising the step of:

adjusting the rate of the flow of hot gas.

50. The waste heat recovery method of claim 49, wherein adjustment of the rate of flow of hot gas controls the superheat temperature of the flow of multicomponent working fluid.

51. The waste heat recovery method of claim 43, further comprising the step of:

adjusting the rate of the flow of multicomponent working fluid.

52. The waste heat recovery method of claim 51, wherein adjustment of the rate of flow of multicomponent working fluid controls the superheat temperature of the flow of multicomponent working fluid.

53. The waste heat recovery method of claim 43, wherein the flow of multicomponent working fluid is a once through flow and the transfer of heat from the flow of hot gas to the flow of multicomponent working fluid fully vaporizes the multicomponent working fluid.

54. The waste heat recovery method of claim 43, wherein:

the flow of hot gas is in a first general direction;

the flow of multicomponent working fluid is in a second general direction; and the second general direction is opposite to the first general direction.

55. The waste heat recovery method of claim 54, wherein:

the flow of hot gas is in a generally upward direction; and the flow of multicomponent working fluid is in a generally downward direction.

56. The waste heat recovery method of claim 43, wherein:

the flow of multicomponent working fluid begins at an elevation higher than an elevation at which it ends; and the flow of hot gas begins at an elevation lower than an elevation at which it ends.

57. The waste heat recovery method of claim 43, wherein the flow of multicomponent working fluid follows a meandering path.

58. The waste heat recovery method of claim 43, wherein the flow of multicomponent working fluid is directed along first paths and second paths, the transfer of heat to the flow of multicomponent working fluid along the first paths vaporizes the multicomponent working fluid and along the second paths superheats the vaporized multicomponent working fluid, and further comprising the step of:

equalizing at least one of a pressure and a temperature of the vaporized multicomponent working fluid from the first paths prior to directing the vaporized multicomponent working fluid along the second paths.

59. The waste heat recovery method of claim 43, wherein the transfer of heat to the flow of multicomponent working fluid isothermally boils the multicomponent working fluid.

60. The waste heat recovery method of claim 43, wherein the flow of hot gas is a first flow of hot gas, and further comprising the step of:

directing a second flow of the hot gas from the waste heat source concurrent with the directing of the first flow of hot gas;

wherein the flow of mulicomponent working fluid is directed so as to avoid a transfer heat from the second flow of hot gas to the flow of multicomponent working fluid.

61. The waste heat recovery method of claim 60, further comprising the step of:

controlling the rate of the second flow of hot gas.

62. The waste heat recovery method of claim 61, wherein the control of the rate of the second flow of hot gas controls the superheat temperature of the flow of multicomponent working fluid.

63. The waste heat recovery method of claim 43, wherein the transfer of heat to the flow of multicomponent working fluid partially vaporizes the multicomponent working fluid, and further comprising the step of:

separating the partially vaporized multicomponent working fluid into a vaporized multicomponent working fluid and a liquid multicomponent working fluid.

64. The waste heat recovery method of claim 43, wherein the transfer of heat to the flow of multicomponent working fluid partially vaporizes the multicomponent working fluid in a first mode and fully vaporizes the multicomponent working fluid in a second mode, and further comprising the step of:

separating the partially vaporized multicomponent working fluid into a vaporized multicomponent working fluid and a liquid multicomponent working fluid only in the first mode.

65. The waste heat recovery method of claim 64, wherein the second mode is a normal mode.

66. The waste heat recovery method of claim 64, wherein the first mode is a start-up mode.

67. The waste heat recovery method of claim 43, wherein the transfer of heat to the flow of multicomponent working fluid superheats the multicomponent working fluid, and further comprising:

expanding the superheated multicomponent working fluid to generate power; and cooling the expanded multicomponent working fluid by transferring heat from the expanded multicomponent working fluid to other multicomponent working fluid, the cooled multicomponent working fluid forming a feed fluid for the flow of multicomponent working fluid.

68. The waste heat recovery method of claim 43, wherein the transfer of heat to the flow of multicomponent working fluid partially vaporizes the multicomponent working fluid, and further comprising the step of:

separating the partially vaporized multicomponent working fluid into a vaporized multicomponent working fluid and a liquid multicomponent working fluid, the transfer of heat to the flow of multicomponent working fluid superheats the vaporized multicomponent working fluid;

expanding the superheated multicomponent working fluid to generate power;

cooling the expanded multicomponent working fluid by transferring heat from the expanded multicomponent working fluid to other multicomponent working fluid, the cooled multicomponent working fluid forming a feed fluid for the flow of multicomponent working fluid; and cooling the liquid multicomponent working fluid by transferring heat from the liquid multicomponent working fluid to other multicomponent working fluid, the cooled multicomponent working fluid forming a feed fluid for the flow of multicomponent working fluid.

* * * * *